US005944852A

United States Patent [19]

Lin et al.

[11] Patent Number: 5,944,852

[45] Date of Patent: Aug. 31, 1999

[54] DYEING PROCESS

[75] Inventors: Tingdong Lin, Wilmington, Del.; Gregory D. George, Rocky Face, Ga.; Mark A. Brophy, Chattanooga, Tenn.; Debra N. Hild, Cantonment; Doris A. Culberson, Pensacola, both of Fla.; Theresa M. Ortega, San Diego, Calif.; P. Robert Peoples; Bascum Harry Duke, both of Pensacola, Fla.

[73] Assignee: Solutia Inc., St. Louis, Mo.

[21] Appl. No.: 09/064,351

[22] Filed: Apr. 22, 1998

Related U.S. Application Data

[63] Continuation-in-part of application No. 08/736,032, Oct. 23, 1996, Pat. No. 5,830,240.

[51] Int. Cl.[6] ..... D06P 1/52; D06P 1/54; D06P 1/62; D06P 1/66

[52] U.S. Cl. ..... 8/478; 8/445; 8/483; 8/552; 8/561; 8/541; 8/542; 8/611; 8/606; 8/609; 8/557

[58] Field of Search ..... 8/478, 483, 541, 8/542, 606, 611, 552, 561, 609, 554, 557

[56] References Cited

U.S. PATENT DOCUMENTS

| | | | |
|---|---|---|---|
| Re. 30,143 | 11/1979 | Vertegaal | 101/120 |
| 2,330,775 | 9/1943 | Bock | 8/120 |
| 3,518,184 | 6/1970 | Potter | 252/8.75 |
| 3,549,530 | 12/1970 | Proffitt | 252/8.8 |
| 3,560,382 | 2/1971 | Finch | 252/8.9 |
| 3,630,259 | 12/1971 | Brignac | 152/359 |
| 3,649,535 | 3/1972 | Clark et al. | 252/8.75 |
| 3,652,419 | 3/1972 | Karg | 252/8.8 |
| 3,653,955 | 4/1972 | Habib | 117/139.5 A |
| 3,859,122 | 1/1975 | Burks et al. | 117/138.8 |
| 3,869,250 | 3/1975 | Wegmuller et al. | 8/15 |
| 4,030,880 | 6/1977 | Holfeid et al. | 8/15 |
| 4,179,544 | 12/1979 | Newkirk et al. | 428/395 |
| 4,245,992 | 1/1981 | Yamashita et al. | 8/461 |
| 4,263,009 | 4/1981 | Brendle et al. | 8/495 |
| 4,391,605 | 7/1983 | Bakker | 8/495 |
| 4,416,787 | 11/1983 | Marshall et al. | 252/8.8 |
| 4,441,884 | 4/1984 | Baumann et al. | 8/542 |
| 4,446,034 | 5/1984 | Kolbe et al. | 252/8.8 |
| 4,455,147 | 6/1984 | Lewis et al. | 8/471 |
| 4,475,920 | 10/1984 | Baumann | 8/542 |
| 4,519,803 | 5/1985 | Clare et al. | 8/445 |
| 4,583,987 | 4/1986 | Kurz | 8/495 |
| 4,693,728 | 9/1987 | Clare et al. | 8/561 |
| 4,715,863 | 12/1987 | Navratil et al. | 8/440 |
| 4,728,337 | 3/1988 | Abel et al. | 8/606 |
| 4,734,277 | 3/1988 | Login | 424/70 |
| 4,740,214 | 4/1988 | McBride et al. . | |
| 4,764,306 | 8/1988 | Login | 260/404 |
| 4,812,263 | 3/1989 | Login | 260/404 |
| 4,818,245 | 4/1989 | Jachowicz et al. | 252/8.8 |
| 4,826,504 | 5/1989 | Clare et al. | 8/561 |
| 4,859,208 | 8/1989 | Clare et al. | 8/557 |
| 4,872,325 | 10/1989 | Moser et al. | 68/200 |
| 4,906,413 | 3/1990 | Töpfl et al. | 260/404.5 |
| 4,966,725 | 10/1990 | Singer et al. | 252/8.8 |
| 5,006,125 | 4/1991 | Patton et al. | 8/188 |
| 5,082,697 | 1/1992 | Patton et al. | 427/340 |
| 5,153,317 | 10/1992 | Ortega et al. | 8/543 |
| 5,252,103 | 10/1993 | Kamata et al. | 8/554 |
| 5,320,646 | 6/1994 | Patton et al. | 8/188 |
| 5,348,557 | 9/1994 | von der Eltz et al. | 8/188 |
| 5,403,358 | 4/1995 | Aston et al. | 8/445 |
| 5,435,807 | 7/1995 | Kuhn | 8/490 |
| 5,525,243 | 6/1996 | Ross | 252/8.6 |
| 5,645,751 | 7/1997 | Haley | 252/8.91 |

FOREIGN PATENT DOCUMENTS

| | | | |
|---|---|---|---|
| 1587930 | 4/1981 | United Kingdom | D06P 5/00 |

OTHER PUBLICATIONS

Annis et al, *Xanthan: An Effective Antimigrant For Dissolved Substances, American Dyestuff Reporter*, 85 (2): 39–44 and 48 (1996).

Dyeing Primer, *A Series of Short Papers on the Fundamentals of Dyeing, Textile Chemist And Colorist*, 2–38 (1987).

A brochure entitled: *Xanthan Gum—Natural Biogum for Scientific Water Control*, Kelco, Fifth Edition.

A brochure entitled: *Alginate Products For Scientific Water Control*, Kelco, Third Edition.

Stanley E. Ross, "Fiber Finish Challenges for the 90's," Henkel Corporation, pp. 1–6 (May 1993).

"Surfactants A Comprehensive Guide," Research and Development Staffs of Kao Corporation, pp. 111–138 (Apr. 1983).

W. Postman, "Spin Finishes Explained," Textile Research Journal, pp. 444–435 (Jul. 1980).

Dr. N.B. Nevrekar et al., "Spin Finishes for Synthetic Fibers—Part IV," Man–Made Textiles in India, pp. 331–336 (Sep. 1991).

Davis E. Lee, Ph.D., "Surfactants in Spin Finishes," , IFJ, pp. 94–100 (Aug. 1991).

H.D. Weigmann, "Finish Distribution and its Effect on Fiber, Yarn, and Fabric Properties," TRI/Princeton, Quarterly Status Report No. 5, pp. 1–5 (Jul. 21, 1993).

R. Gutmann et al., "Spinfinishes—Correlation Between Structure and Effectiveness," Chemiefasern/Textilindustrie (CTI), vol. 42/94, pp. 886–893 (Nov. 1992).

*Primary Examiner*—Margaret Einsmann
*Attorney, Agent, or Firm*—Arnold, White & Durkee

[57] ABSTRACT

Improved dyeing processes for yarn and fabric materials are described. Dye pattern definition on a textile material is enhanced by treating the fabric or the fibers from which it is made with a quaternary ammonium compound and by including in the dye composition a gum which will react with the quaternary ammonium compound to form a viscous gel. The gel minimizes migration of the dye prior to fixation of the dye, and therefore pattern definition is improved. Similar improvements can be obtained when space dyeing yarn that comprises fibers that have been so treated.

14 Claims, No Drawings

DYEING PROCESS

This is a continuation-in-part of U.S. Ser. No. 08/736,032, filed on Oct. 23, 1996 now U.S. Pat. No. 5,830,240.

BACKGROUND OF THE INVENTION

The present invention is generally related to pattern dyeing of textile materials or space dyeing of yarn in which the fibers constituting the yarn or textile material have been treated with a finish composition that improves pattern definition and color saturation.

Textile materials, including fabric, cloth, drapery material, velour, velvet, velveteen, corduroy, rugs, carpet and the like are commonly printed with patterns of natural or synthetic dyes by well known processes, such as transfer printing, jet dye injection, screen printing, Kuster printing, and the like. However, despite the success of many of these techniques, undesirable characteristics such as poor pattern definition, low dye yield, and "frostiness", a visual effect in which the surface of the material appears covered in a thin frosting of ice, are the focus of continuing research efforts within the industry. Many of these undesirable characteristics are believed to be due to uncontrolled dye diffusion or moisture transport during the initial transfer of the dyestuff solution to the textile material and during the first moments of the steam treating process that fixes the dye to the fibers that make up the textile material.

Yarns are sometimes dyed using a process referred to as space dyeing. In this process a strand of yarn can be dyed with more than one color at irregular intervals along its length, before the yarn is processed into fabric. Space dyeing of yarn can suffer from some of the same dye pattern definition problems described above with respect to fabric.

Previous attempts to overcome these problems have met with only limited success and acceptance. One approach has been the incorporation into the dyestuff solution of thickeners to reduce or prevent the diffusion of the dyestuff into the fiber. Examples of such anti-diffusion agents include natural and synthetic gums, such as alginates, xanthan gum, guar, starch, carboxymethyl cellulose, natural and synthetic resins and the like. However, the synthetic gum systems are not robust, that is, they are sensitive to salts and metal ions which reduce or degrade the viscosity of the dyestuff solution. This in turn reduces the amount of dyestuff that is actually fixed to the fibers of the textile material, leading to the wasteful use of these expensive materials.

Another approach, disclosed in U.S. Pat. No. 4,740,214, uses an ionic interaction between an ionic polymer in the dyestuff solution and a counter ionic polymer coated onto the textile material. That patent suggests that the ionic interaction of the two polymers, once brought into contact with each other, forms a "skin" about the droplets of the dyestuff solution which adhere to the surface of the fiber. When the printed textile material is steam treated in the fixing process, the skin breaks and the dyestuff is fixed before diffusion can occur. This approach likely would require additional process machinery for pretreating the textile material before dyeing and would add additional steps and thus cost to the dyeing process.

A long-standing need exists for simple and economical improved processes for pattern dyeing of textiles and space dyeing of yarns that can avoid problems such a poor pattern definition and frostiness.

SUMMARY OF THE INVENTION

The present invention concerns a process for space dyeing yarn or pattern dyeing a textile material. The process includes the steps of (1) providing a dyeable material that comprises a plurality of fibers and is selected from the group consisting of textile and fabric material, wherein the fibers have been treated with a cationic cross-linking agent; and (2) applying to selected areas of the dyeable material a pattern of a dyestuff solution that comprises a dyestuff and a water-soluble polymeric thickening agent. The cationic cross-linking agent and the polymeric thickening agent react to form a viscous gel that is effective to reduce migration of dye on the yarn or textile material. Typically the process will include the additional step of fixing the dyestuff as soon as practical after the dyestuff is applied. The formation of the viscous gel prevents the dyestuff from migrating before it is fixed, and thus improves the dye pattern definition.

Preferred cationic cross-linking agents are quaternary ammonium compounds selected from the group consisting of diquaternary ammonium compounds and triquaternary ammonium compounds. It has been found that diquaternary and triquaternary ammonium compounds are much less likely to cause formation of an insoluble precipitate when contacted with the polymeric thickening agent than are monoquaternary and polyquaternary ammonium compounds. Especially preferred are alkyl substituted diquaternary or triquaternary ammonium compounds. For example, the quaternary ammonium compound can suitably be a salt that comprises a diquaternary or triquaternary ammonium cation and an anion selected from the group consisting of halide, sulfate, nitrate, acetate, and mixtures thereof.

The polymeric thickening agent preferably is a gum. In an especially preferred embodiment, the polymeric thickening agent is algin.

The fibers that are treated with the quaternary ammonium compound preferably have also been treated with a glycol, such as propylene glycol. This can be accomplished by including both the quaternary ammonium compound and the glycol in a fiber finish composition that is applied to the fibers, either at the conclusion of the fiber manufacturing process, or during or after the formation of a yarn or fabric material from the fibers.

The present invention has a number of advantages over prior art processes. Pattern definition and color saturation are improved and frostiness is reduced, without excessively increasing the cost of making fibers, yarn, or textile material. Further, the process of the present invention can be performed in existing manufacturing facilities and equipment with little or no modification and without adding process steps, thereby facilitating the implementation of the present invention at a relatively low cost.

DESCRIPTION OF ILLUSTRATIVE EMBODIMENTS

The following terms used herein are intended to have the following meanings:

"dyeability" is the ability of a fiber in a yarn or textile material to be fixed with a dyestuff;

"dyestuff" is any natural or synthetic compound or mixture of compounds used to color or dye the fibers of a yarn or textile material to achieve a desired visual effect;

"textile material" is any spun, knitted, woven, pressed, non-woven, or otherwise formed material made from natural or synthetic fibers or mixtures or blends thereof, including fabric, cloth, drapery material, velour, velvet, velveteen, corduroy, rugs, carpet and the like onto which printing or patterning is desired;

"fiber" is any natural or synthetic fiber, in continuous filament or staple form which may be spun, knitted, woven, pressed or otherwise formed into a textile material, including as examples cotton, wool, hemp, flax, animal hair, nylon or other polyamide, polyester, polyolefin, and combinations or blends of these materials.

The present invention is generally directed to a process for space dyeing yarn or for dyeing textile material with a pattern of dye, as opposed to applying dye uniformly across a strand of yarn or a piece of textile. In other words, in the case of textile as the dyeable material, dye is applied to the textile is a predetermined pattern, such that dye is applied to some regions of the textile surface but not to other adjacent regions of the textile surface. A variety of natural and synthetic fibers can be used to form the yarn or textile material. Nylon 6,6 is a preferred example. The manufacturing of the fiber will be performed in a conventional manner as known in the art, except that a modified finish composition will be applied to the fiber. A "finish composition" is a mixture of substances, usually in a liquid solvent or carrier, that is applied to a fiber to impart desirable properties, such as lubricating the fiber and reducing static build-up during the yarn construction process and the weaving, knitting, tufting or other processing used to make the textile material. Conventional finish compositions are often formulated to include lubricating agents, wetting agents, antistatic agents, leveling agents and other components which are normally liquids at room temperature. Fiber finish compositions are described in a number of U.S. Patents including U.S. Pat. Nos. 3,518,184, 3,549,530, 3,859,122, 4,179,544, 4,416,787, 4,446,034, 4,583,987, 4,906,413, and 5,525,243, which are incorporated herein by reference.

A fiber finish composition suitable for treating fibers to be used in the present invention includes a cationic cross-linking agent. This agent is preferably a diquaternary or triquaternary ammonium salt, comprising an alkyl substituted quaternary ammonium cation and an anion that does not interfere with the dyeing process. Preferably the anion is selected from the group including halide, sulfate, nitrate, acetate and mixtures thereof.

Suitable alkyl substituted quaternary ammonium cations preferably are solid or semi-solid at ambient temperatures. Thus preferred quaternary ammonium compounds have a melting point from about 10° C. to about 110° C., more preferably from about 40° C. to about 70° C.

A preferred quaternary ammonium salt comprises a cation having the general formula:

$$[(H_{2x+1}C_x)(H_{2y+1}C_y)(H_{2z+1}C_z)N(CH_2)_nCH(OR)(CH_2)_{n'}N(C_{x'}H_{2x'+1})(H_{2y'+1}C_{y'})(H_{2z'+1}C_{z'})]^{++}$$

wherein x and x' have a value from 1 to 4; y and y' have a value from 1 to 4; z and z' have a value from 1 to 20; n and n' have a value from 1 to 20; and, R is selected from the group consisting of hydrogen and $C_1$ to $C_6$ straight, branched and cyclic alkyl groups. In a particularly preferred embodiment, the values of x, x', y, y', n and n' are all 1 and R is hydrogen.

One suitable example of such a quaternary ammonium compound is 2-hydroxypropylene-bis-1,3-(dimethyl stearyl ammonium chloride). This compound is commercially available from BASF as M-Quat Dimer 18 PG, which is a suspension of the compound in propylene glycol.

Although the presence of the glycol is not required in the finish composition, it is believed to have some advantages. Without being bound by theory, it is believed that the glycol may act as a swelling agent and aid in absorption of dye into the fiber, as opposed to merely being coated onto the surface of the fiber, and thus minimize the extent to which the dye will be removed from the fiber or fabric by abrasion.

The improved finish composition is preferably applied to the fiber in the form of an aqueous emulsion in which the non-aqueous components are from about 5% to about 30% by weight of the total composition. Sufficient amounts of the aqueous finish composition are applied to the fibers so that the final dry fibers preferably will have a coating of the non-aqueous components of the finish composition from about 0.6% to about 2.5% by weight of the total fiber weight, and preferably from about 1.0% to 1.5% by weight. The finish composition of the present invention could alternatively be applied using suitable organic solvents, instead of as an aqueous suspension. The amount of the finish composition applied should be sufficient so as to lubricate the fiber as well as increase the dyeability of the textile material which in turn results in increased pattern definition, increased color saturation and reduced frostiness in the final textile material.

Formulation of the improved finish compositions of the present invention takes place using conventional formulating and mixing technologies that are known to those skilled in the art. As noted above, the preferred base material for the improved finishing compositions is a conventional finish composition to which the quaternary ammonium compound is added. The amounts used should be sufficient to enhance the dyeability of the fiber, but not so great as to eliminate the lubricating, antistatic and other properties of the base finish composition.

Preferably the finish composition has a pH comparable to that of the dyestuff solution that is to be used in dyeing the textile material. In embodiments in which acid dyestuffs are used, the pH value of the finish composition should be equal to or less than about 7 and more preferably from about 3 to about 6. Strong anionic chelating agents that are carbonate based, such as ethylenediaminetetraacetate (EDTA) or phosphonates should be avoided.

The finish compositions are typically sprayed, kiss-rolled, metered, padded or otherwise coated onto the fibers before the fiber is gathered onto spools, spindles, totes, bales or other conventional transport means. However, it would also be possible to apply the quaternary ammonium compound to the fibers after those fibers are formed into yarn or fabric. In this variation, a conventional finish composition is used in the fiber manufacturing process. After the fibers are formed into yarn or fabric, a "dyeing" finish composition including the quaternary ammonium cation is applied before dyeing takes place. Suitable application methods will be apparent to those of ordinary skill in the art and include spraying, dipping, coating, rolling and the like. The amount of ammonium compound used in the "dyeing" finish composition of this embodiment will be sufficient to enhance the dyeability of the textile material. As another variation, the quaternary ammonium compound could be applied to the fabric simultaneously with the dye.

The methods and apparatus used to prepare yarn and textile material from fibers are well known in the art.

After yarn is formed from the fibers, space dyeing of the yarn can be performed as is well known in the art, but with the polymeric thickening agent in the dye solution. If the dyeing is performed on textile instead of a strand of yarn, the pattern dyeing operation is performed by a technique such as jet injection dyeing, screen printing, Kuster printing and dyeing, warp printing, space dyeing, continuous yarn dyeing, and other low wet pickup dyeing techniques known in the art. The dye solution includes both dye and a water-soluble polymeric thickening agent capable of reacting with the quaternary ammonium compound. Anionic polymers are preferred for use as the thickening agent. Gums such as algin as especially preferred. It is also preferred that the polymeric thickening agent include a carboxyl moiety. Synthetic acrylic polymers are not preferred for use as the thickening agent.

When the quaternary ammonium cation contacts the gum or other polymeric thickening agent in the dye solution, a reaction occurs that forms a viscous gel, which retards dye migration. This viscous gel is believed to result from crosslinking of the polymeric thickening agent, and is distinct from the "skin" formed by the system described in U.S. Pat. No. 4,740,214. The degree of interaction of the quaternary ammonium cation and the polymeric thickening agent (for example, an anionic gum) can be measured by the viscosity increase when the fiber finish composition is mixed with the dye composition.

After the dye application, the dye is fixed to the textile, for example by contacting the dyed textile with steam, in a manner that is well known in the art.

The present invention achieves high levels of pattern definition and color saturation without the need for additional machinery or adding process steps to conventional fiber or fabric manufacturing systems.

The following examples are included to demonstrate specific embodiments of the invention. Persons skilled in the art will recognize that many changes can be made in the specific embodiments which are disclosed without departing from the spirit and scope of the invention.

Example 1

Fiber finish compositions were prepared containing the materials listed in Tables 1 and 2.

TABLE 1

| Chemical Name | wt % |
|---|---|
| ethoxylated triglyceride | 17–20 |
| 2-hydroxypropylene-bis-1,3-(dimethyl stearyl ammonium chloride) (50% in propylene glycol) | 6–16 |
| ethylene oxide-propylene oxide random copolymer | 13–23 |
| ethoxylated coconut glycerides | 8–18 |
| coconut oil | 5–15 |
| ethoxylated alcohol | 2–4 |
| ethoxylated alcohol phosphate, potassium salt | 5–15 |
| ethoxylated ester | 8–18 |

TABLE 2

| Chemical Name | wt % |
|---|---|
| ethoxylated hydrogenated triglyceride | 17–27 |
| 2-hydroxypropylene-bis-1,3-(dimethyl stearyl ammonium chloride) (50% in propylene glycol) | 20–30 |
| ethoxylated coconut glycerides | 13–23 |
| triglyceride ester | 14–24 |
| ethoxylated alcohol phosphate, potassium salt | 6–10 |
| ethoxylated acid ester | 6–10 |
| antioxidant | 0–1 |
| water | 0–2 |

Water was added to the compositions shown in Tables 1 and 2 such that the added water was approximately 86% by weight of the overall fiber finish compositions. These compositions were then applied to different lots of nylon 6,6 fibers.

When the fibers treated with the compositions of Tables 1 or 2 were formed into fabric, and the fabric was pattern dyed with a dye solution that comprised algin, a viscous gel formed, and migration of the dye prior to dye fixation was inhibited. Dye pattern definition was visibly improved.

The preceding description of specific embodiments of the present invention is not intended to be a complete list of every possible embodiment of the invention. Persons skilled in this field will recognize that modifications can be made to the specific embodiments described here that would be within the scope of the present invention.

What is claimed is:

1. A process for dyeing a yarn or a textile material, comprising:

providing a dyeable material that comprises a plurality of fibers and is selected from the group consisting of yarn and textile materials, wherein the fibers have been treated with a cationic cross-linking agent;

applying to selected areas of the dyeable material a pattern of a dyestuff solution that comprises a dyestuff and a water-soluble polymeric thickening agent; and forming a viscous gel from the reaction of the cationic cross-linking agent and the polymeric thickening agent, wherein the viscous gel is effective to reduce migration of dye on the dyeable material.

2. The process of claim 1 wherein the dyeable material is a textile material and wherein the process further comprises the step of fixing the dyestuff on the textile material.

3. A process for dyeing a yarn or a textile material, comprising:

providing a dyeable material that comprises a plurality of fibers and is selected from the group consisting of yarn and textile materials, wherein the fibers have been treated with a cationic cross-linking agent, wherein the cationic cross-linking agent is a quaternary ammonium compound selected from the group consisting of diquaternary ammonium compounds and triquaternary ammonium compounds;

applying to selected areas of the dyeable material a pattern of a dyestuff solution that comprises a dyestuff and a water-soluble polymeric thickening agent;

whereby the cationic cross-linking agent and the polymeric thickening agent react to form a viscous gel that is effective to reduce migration of dye on the dyeable material.

4. The process of claim 3 wherein the quatemary ammonium compound is an alkyl substituted diquatemary or triquaternary ammonium compound.

5. The process of claim 4 wherein the quaternary ammonium compound comprises an alkyl substituted quaternary ammonium cation that has the general formula:

$$[(H_{2x+1}C_x)(H_{2y+1}C_y)(H_{2z+1}C_z)N(CH_2)_nCH(OR)(CH_2)_{n'}N(C_{x'}H_{2x'+1})(H_{2y'+1}C_{y'})(H_{2z'+1}C_{z'})]^{++}$$

wherein x and x' have a value from 1 to 4; y and y' have a value from 1 to 4; z and z' have a value from 1 to 20; n and n' have a value from 1 to 20; and, R is selected from the group consisting of hydrogen and $C_1$ to $C_6$ straight, branched and cyclic alkyl groups.

6. The process of claim 5 wherein the values of x, x', y, y', n and n' are all 1 and R is hydrogen.

7. The process of claim 3 wherein the quaternary ammonium compound is a salt that comprises a diquatemary or triquatemary ammonium cation and an anion selected from the group consisting of halide, sulfate, nitrate, acetate, and mixtures thereof.

8. The process of claim 7 wherein the quaternary ammonium compound is 2-hydroxypropylene-bis-1,3-(dimethyl stearyl ammonium chloride).

9. The process of claim 1 wherein the fibers are nylon.

10. The process of claim 1 wherein the polymeric thickening agent is a gum.

11. The process of claim 10 wherein the gum is anionic.

12. The process of claim 10 wherein the polymeric thickening agent is algin.

13. The process of claim 3 wherein the fibers have been treated with both a quaternary ammonium compound and a glycol.

14. The process of claim 13 wherein the glycol is propylene glycol.

* * * * *

UNITED STATES PATENT AND TRADEMARK OFFICE

CERTIFICATE OF CORRECTION

PATENT NO. : 5,944,852

DATED : August 31, 1999

INVENTOR(S) : Tingdong Lin, et al.

Attorney Docket No.: SOLU:086/LUD

It is certified that error appears in the above-identified patent and that said Letters Patent is hereby corrected as shown below:

In claim 4, col. 6, line 44, delete "quatemary" and insert --quatenary-- therefor.

In claim 4, col. 6, line 45, delete "diquatemary" and insert --diquatenary-- therefor.

In claim 7, col. 6, line 61, delete "diquatemary" and insert --diquatenary-- therefor.

In claim 7, col. 6, line 62, delete "triquatemary" and insert --triquatenary-- therefor.

Signed and Sealed this

Eighteenth Day of July, 2000

*Attest:*

Q. TODD DICKINSON

*Attesting Officer*

*Director of Patents and Trademarks*